US008435110B2

(12) United States Patent
Svanas

(10) Patent No.: US 8,435,110 B2
(45) Date of Patent: May 7, 2013

(54) PLAYER INTERACTIVE WAGERING USING HOLE SYMBOLS AND SHIFTING GAMING SYMBOLS

(75) Inventor: Galen Tanner Svanas, Austin, TX (US)

(73) Assignee: Multimedia Games, Inc., Austin, TX (US)

( * ) Notice: Subject to any disclaimer, the term of this patent is extended or adjusted under 35 U.S.C. 154(b) by 384 days.

(21) Appl. No.: 12/463,182

(22) Filed: May 8, 2009

(65) Prior Publication Data

US 2010/0285860 A1 Nov. 11, 2010

(51) Int. Cl.
*A63F 9/24* (2006.01)

(52) U.S. Cl.
USPC ..... 463/20

(58) Field of Classification Search ..... 463/20
See application file for complete search history.

(56) References Cited

U.S. PATENT DOCUMENTS 5,769,716 A 6/1998 Saffari et al.
6,855,054 B2 * 2/2005 White et al. ..... 463/21
7,144,322 B2 12/2006 Gomez et al.
7,371,170 B2 5/2008 Cregan et al.
7,690,985 B1 * 4/2010 Muskin et al. ..... 463/20
7,713,122 B2 * 5/2010 Pacey ..... 463/25
7,753,773 B2 * 7/2010 Baerlocher et al. ..... 463/20
2004/0072605 A1 4/2004 Toyoda
2005/0054414 A1 * 3/2005 Gauselmann ..... 463/16
2006/0205473 A1 * 9/2006 Gomez et al. ..... 463/16
2007/0060246 A1 * 3/2007 Baerlocher et al. ..... 463/16
2008/0045318 A1 2/2008 Saito
2008/0045325 A1 2/2008 Kato
2008/0051174 A1 2/2008 Fiden
2008/0058063 A1 3/2008 Okada
2008/0064485 A1 3/2008 Tedsen et al.

* cited by examiner

*Primary Examiner* — William D Coleman
*Assistant Examiner* — Christine Enad
(74) *Attorney, Agent, or Firm* — Nathan H. Calvert, Esq.; Russell D. Culbertson, Esq.; J P Cody, Esq.

(57) ABSTRACT

A game is provided including a symbol shifting graphic display at one or more gaming machines. Games, methods, systems, and program products are taught using gaming symbols and hole symbols, into which gaming symbols may be shifted during the course of the game. Shifted symbols may reveal another hole symbol, or a bonus symbol or multiplier symbol. The player is allowed to select a symbol to shift in order to try and solve the matrix by producing a winning combination of gaming symbols.

10 Claims, 12 Drawing Sheets

PLAYER INTERACTIVE WAGERING USING HOLE SYMBOLS AND SHIFTING GAMING SYMBOLS

TECHNICAL FIELD OF THE INVENTION

This invention relates to gaming systems and to gaming machines through which players may participate in wagering games. More particularly, the invention relates to methods for conducting an interactive wagering game that provides gaming symbols and hole symbols, where the gaining symbols shift into the hole symbols.

BACKGROUND OF THE INVENTION

Many different types of gaming machines have been developed to provide various formats and graphic presentations for conducting games and presenting game results. For example, numerous mechanical reel-type gaining machines, also known as slot machines, have been developed with different reel configurations, reel symbols, and paylines. More recently, gaining machines have been developed with video monitors that are used to produce simulations of mechanical spinning reels. These video-based gaming machines may employ one or more video monitors to provide a wide variety of graphic effects in addition to simulated spinning reels, and may also provide secondary/bonus games using different reel arrangements or entirely different graphics. Many video-based gaming machines have three or five spinning reels that may be stopped to display a matrix of game symbols. The symbols displayed on the stopped reels correlate to a result of the game. Special symbols or bonus symbols are also employed on reel-type displays to enhance the variety of possible outcomes.

Game manufacturers are continuously pressed to develop new game presentations, formats, and game graphics in an attempt to provide high entertainment value for players and thereby attract and keep players.

SUMMARY OF THE INVENTION

The present invention includes a highly entertaining method of conducting a game for one or more players. The entertainment value is achieved partially by a game including gaming symbols and hole symbols, into which gaming symbols may be shifted during the course of the game. The present invention encompasses methods for operating one or more gaming machines as well as both apparatus and program products for implementing the gaming machine operation methods.

A method embodying principles of the invention may be implemented in a gaming machine using one or more display devices such as CRTs, LCDs, plasma displays, or other types of video display devices. The display device or devices are used to show the variable graphic elements according to the invention. As used in this disclosure and the accompanying claims, a gaming machine through which the present invention may be implemented will be referred to generally as a gaming machine regardless of the nature of the display device arrangement used to display portions graphical elements of the game to the player, and regardless of the manner in which the display device arrangement operates.

A method according to one form of the invention includes receiving a wager input from the player and displaying a matrix of symbol locations having a number of first symbols of a first symbol type at first selected locations in the matrix, the first symbol type indicative of elements in the matrix that are made available to be used in forming patterns according to rules of the game. Further displayed is a number of second symbols of a second symbol type at second selected locations in the matrix, the second symbol type indicative of hole elements in the matrix that may receive shifting symbols from other symbol locations in the matrix. The method receives a first player selection input indicating a chosen one of the first symbols in the matrix to be moved to the location of a selected adjacent one of the second symbols. In response, the chosen one of the first symbols is shifted into the location of a selected adjacent one of the second symbols. After each symbol shift, the game preferably evaluates the matrix for presence of one or more winning patterns formed by the first symbols. If there is a winning pattern, the method awards a wager win result to the player.

A gaming system according to one embodiment includes (i) a display arrangement having one or more display devices, (ii) a player input device arrangement having one or more player input devices, and (iii) a game controller arrangement. The gaining controller arrangement may cooperate with a server to accomplish one or more of its functions. The controller conducts the game by causing the display device to display a matrix of symbol locations having a number of first symbols of a first symbol type at first selected locations in the matrix, the first symbol type indicative of elements in the matrix that are made available to be used in forming patterns according to rules of the game. Further displayed is a number of second symbols of a second symbol type at second selected locations in the matrix, the second symbol type indicative of hole elements in the matrix that may receive shifting symbols from other symbol locations in the matrix. The controller receives a first player selection input indicating a chosen one of the first symbols in the matrix to be moved to the location of a selected adjacent one of the second symbols. In response, the chosen one of the first symbols is shifted into the location of a selected adjacent one of the second symbols. After each symbol shift, the game preferably evaluates the matrix for presence of one or more winning patterns formed by the first symbols. If there is a winning pattern, the controller arrangement awards a wager win result to the player.

The present invention may also be embodied in a program product stored in one or more computer readable media. That is, the invention may take the form of a computer program that can be installed and run on one or more machines. A preferred computer program version of the invention includes several software modules or sections referred to as "program code." This version of the program product includes gaining activation program code executable for receiving a wager input from the player. Also included is gaining matrix program code executable for causing a display arrangement to (i) display a matrix of symbol locations including a plurality of symbol locations, to (ii) display a number of first symbols of a first symbol type at first selected locations in the matrix, the first symbol type being those elements in the matrix are made available to be used in forming patterns according to rules of the game, and to (iii) display a number of second symbols of a second symbol type at second selected locations in the matrix, the second symbol type indicative of hole elements in the matrix that may receive shifting symbols from other symbol locations in the matrix. The program product also includes player selection program code executable for receiving a first player selection input indicating a chosen one of the first symbols in the matrix to be moved to the location of a selected adjacent one of the second symbols. Further included is symbol shifting program code executable for, in response to receiving the first player selection input, shifting the chosen one of the first symbols into the location of a selected adjacent one of the second symbols. Next included is the game controller program code executable for, after shifting the chosen one of the first symbols, evaluating the matrix for presence of one or more winning patterns formed by the first symbols. Award program code is included, executable for, in response to finding a winning pattern, awarding a wager win result to the player.

One embodiment includes a hidden symbol or multiplier symbol that is revealed by the shifting of symbols in the matrix. In one embodiment, the bonus symbols revealed, and then an animated sequence is shown to indicate that a bonus or a multiplier has been awarded, after which the bonus symbol or multiplier symbol is removed from the matrix in order to leave a constant number of hole symbols so that the game may continue shifting symbols without losing a hole symbol. In other embodiments, the total number of hole symbols will be reduced by one win, a bonus symbol, or multiplier symbol is revealed, but the game will continue shifting symbols until the allotted moves are completed or a winning pattern is formed. In yet another embodiment, revealing a bonus symbol or a multiplier symbol may stop the game and award the bonus associated with the bonus symbol, or may affect the game in another manner such as by adding one or more additional hole symbols to the matrix, or extending the number of moves permitted to try and solve the matrix in the current game round.

In some versions of the game, the player is allowed to select only the first symbol to shift in order to begin solving the matrix to produce a winning pattern. These versions may employ pre-solved solutions that automatically control the shifting of gaming symbols into holes after the player's initial selection. Some other versions allow the player to select symbols a number of times until a designated limit is reached.

Some versions evaluate the symbol matrix after each move to detect a winning pattern, while others evaluate after a preselected number of moves. Still others use a pre-solved sequence of moves that does not require evaluation after each move. The pre-solved sequences are preferably stored in data objects so that they may be selected in response to the player selecting a particular move to make in the gaining matrix. Other embodiments select a gaming result for the game round based on the player's chosen move. In that case, a pre-solved sequence is preferably chosen to implement that gaining result. Other versions include a real-time solver software module to solve the matrix after the player's initial choice.

In one preferred form of the gaming system, the game controller arrangement includes a game server and a respective game client at each one of the one or more gaming machines. The game server is in communication with each of the one or more gaming machines and functions to generating display control commands and communicate the display control commands to each of the one or more gaming machines. Each respective game client functions to respond to the respective display control commands communicated to the respective gaming machine.

These and other advantages and features of the invention will be apparent from the following description of the preferred embodiments, considered along with the accompanying drawings.

DESCRIPTION OF PREFERRED EMBODIMENTS

Figure 1:
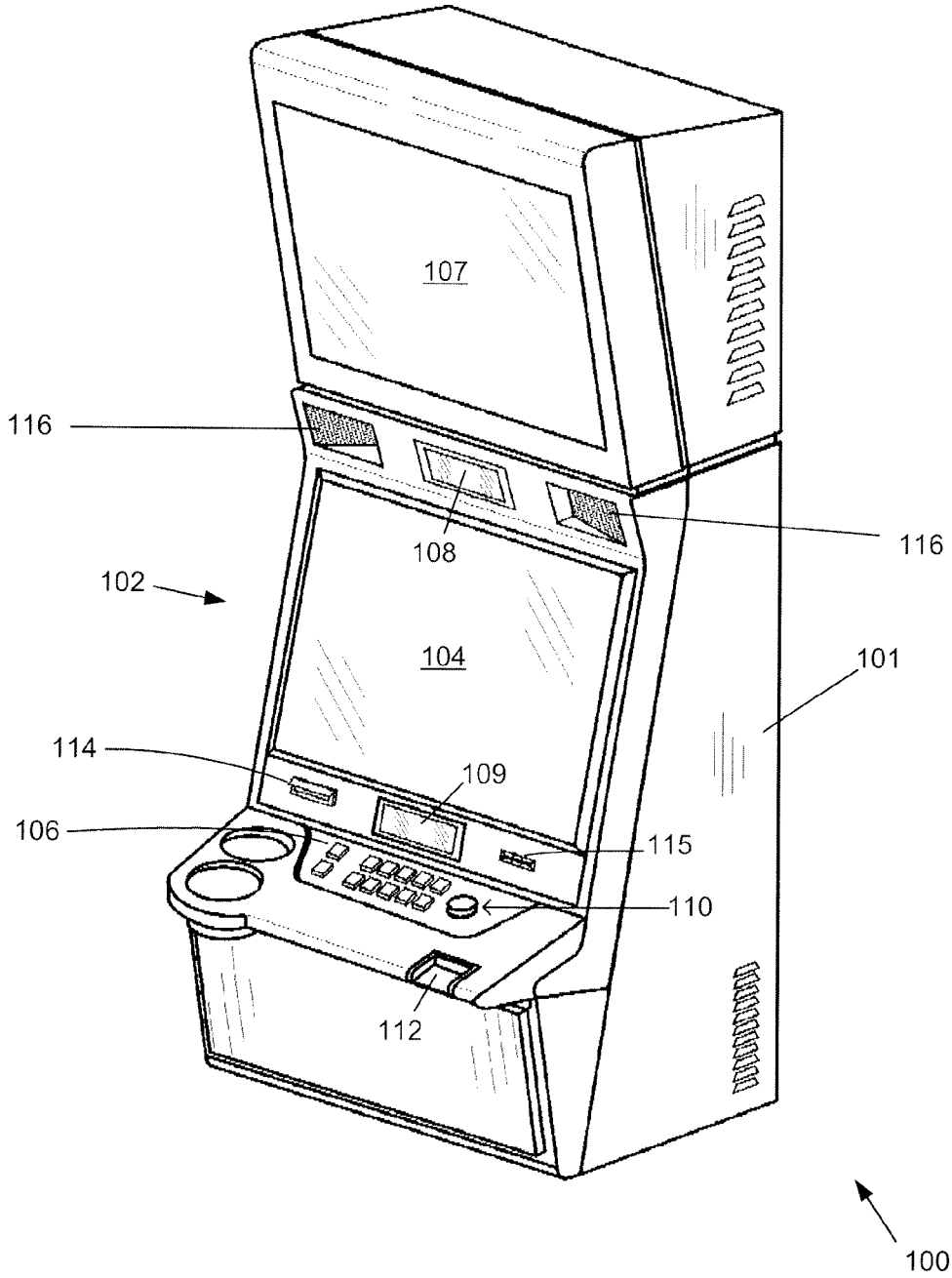
FIG. 1 is a view in front perspective of a gaining machine which may be used in a gaming system embodying the principles of the present invention.
Figure 2:
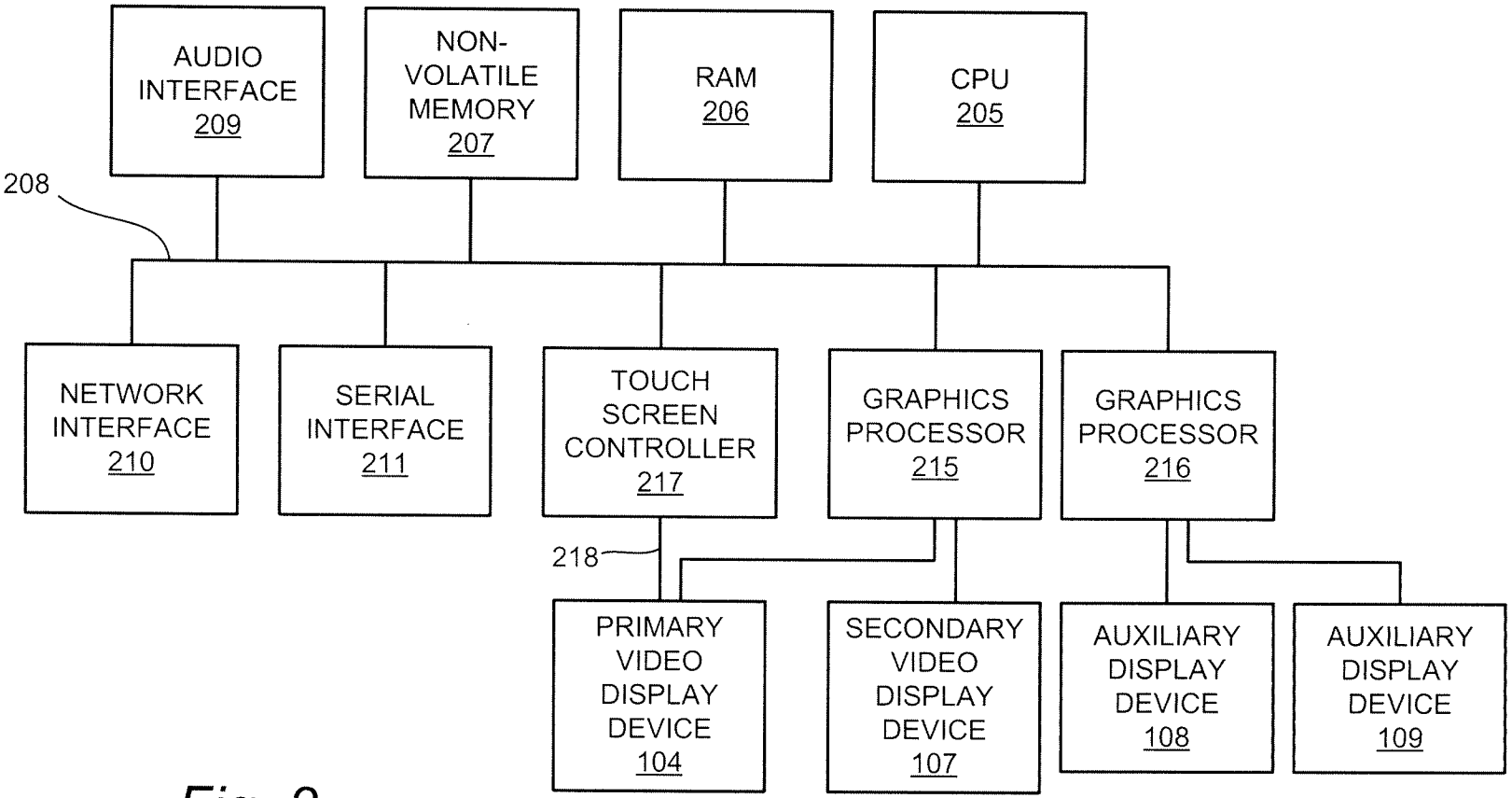
FIG. 2 is a block diagram showing various electronic components of the gaming machine shown in FIG. 1.

FIG. 1 shows a gaming machine 100 that may be used to implement a symbol shifting game according to the present invention. The block diagram of FIG. 2 shows further details of gaming machine 100. Referring to FIG. 1, gaming machine 100 includes a cabinet 101 having a front side generally shown at reference numeral 102. A primary video display device 104 is mounted in a central portion of the front surface 102, with a ledge 106 positioned below the primary video display device and projecting forwardly from the plane of the primary video display device. In addition to primary video display device 104, the illustrated gaining machine 100 includes a secondary video display device 107 positioned above the primary video display device. Gaming machine 100 also includes two additional smaller auxiliary display devices, an upper auxiliary display device 108 and a lower auxiliary display device 109. It should also be noted that each display device referenced herein may include any suitable display device including a cathode ray tube, liquid crystal display, plasma display, LED display, or any other type of display device currently known or that may be developed in the future.

Gaming machine 100, illustrated in FIG. 1, also includes a number of mechanical control buttons 110 mounted on ledge 106. These control buttons 110 may allow a player to select a bet level, select pay lines, select a type of game or game feature, and actually start a play in a primary game. Other forms of gaming machines according to the invention may include switches, joysticks, or other mechanical input devices, and/or virtual buttons and other controls implemented on a suitable touch screen video display. For example, primary video display device 104 in gaming machine 100 provides a convenient display device for implementing touch screen controls.

It will be appreciated that gaming machines may also include a number of other player interface devices in addition to devices that are considered player controls for use in playing a particular game. Gaining machine 100 also includes a currency/voucher acceptor having an input ramp 112, a player card reader having a player card input 114, and a voucher/receipt printer having a voucher/receipt output 115. Audio speakers 116 generate an audio output to enhance the user's playing experience. Numerous other types of devices may be included in gaming machines that may be used according to the present invention.

FIG. 2 shows that gaming machine 100 includes a central processing unit (CPU) 205 along with random access memory (RAM) 206 and nonvolatile memory or storage device 207. All of these devices are connected on a system bus 208 with an audio interface device 209, a network interface 210, and a serial interface 211. A graphics processor 215 is also connected on bus 208 and is connected to drive primary video display device 104 and secondary video display device 107 (both mounted on cabinet 101 as shown in FIG. 1). A second graphics processor 216 is also connected on bus 208 in this example to drive the auxiliary display devices 108 and 109 also shown in FIG. 1. As shown in FIG. 2, gaming machine 100 also includes a touch screen controller 217 connected to system bus 208. Touch screen controller 217 is also connected via signal path 218 to receive signals from a touch screen element associated with primary video display device 104. It will be appreciated that the touch screen element itself typically comprises a thin film that is secured over the display surface of primary video display device 104. The touch screen element itself is not illustrated or referenced separately in the figures.

Those familiar with data processing devices and systems will appreciate that other basic electronic components will be included in gaining machine 100 such as a power supply, cooling systems for the various system components, audio amplifiers, and other devices that are common in gaming machines. These additional devices are omitted from the drawings so as not to obscure the present invention in unnecessary detail.

All of the elements 205, 206, 207, 208, 209, 210, and 211 shown in FIG. 2 are elements commonly associated with a personal computer. These elements are preferably mounted on a standard personal computer chassis and housed in a standard personal computer housing which is itself mounted in cabinet 101 shown in FIG. 1. Alternatively, the various electronic components may be mounted on one or more circuit boards housed within cabinet 101 without a separate enclosure such as those found in personal computers. Those familiar with data processing systems and the various data processing elements shown in FIG. 2 will appreciate that many variations on this illustrated structure may be used within the scope of the present invention. For example, since serial communications are commonly employed to communicate with a touch screen controller such as touch screen controller 217, the touch screen controller may not be connected on system bus 208, but instead include a serial communications line to serial interface 211, which may be a USB controller or a IEEE 1394 controller for example. It will also be appreciated that some of the devices shown in FIG. 2 as being connected directly on system bus 208 may in fact communicate with the other system components through a suitable expansion bus. Audio interface 209, for example, may be connected to the system via a PCI bus. System bus 208 is shown in FIG. 2 merely to indicate that the various components are connected in some fashion for communication with CPU 205 and is not intended to limit the invention to any particular bus architecture. Numerous other variations in the gaming machine internal structure and system may be used without departing from the principles of the present invention.

It will also be appreciated that graphics processors are also commonly a part of modern computer systems. Although separate graphics processor 215 is shown for controlling primary video display device 104 and secondary video display device 107, and graphics processor 216 is shown for controlling both auxiliary display devices 108 and 109, it will be appreciated that CPU 205 may control all of the display devices directly without any intermediate graphics processor. The invention is not limited to any particular arrangement of processing devices for controlling the video display devices included with gaming machine 100. Also, a gaming machine implementing the present invention is not limited to any particular number of video display devices or other types of display devices, provided some display arrangement is included for displaying the symbol shifting graphic, the selectable objects, and the display modifications resulting from the selection of the various selectable objects.

In the illustrated gaming machine 100, CPU 205 executes software which ultimately controls the entire gaining machine including the receipt of player inputs and the presentation of the graphic symbols displayed according to the invention through display devices 104, 107, 108, and 109 associated with the gaining machine. As will be discussed further below, CPU 205 either alone or in combination with graphics processor 215 may implement a presentation controller for performing functions associated with a primary game that may be available through the gaming machine and may also implement a game client for directing one or more display devices at the gaining machine to display portions of a symbol shifting game according to the present invention. CPU 205 also executes software related to communications handled through network interface 210, and software related to various peripheral devices such as those connected to the system through audio interface 209, serial interface 211, and touch screen controller 217. CPU 205 may also execute software to perform accounting functions associated with game play. Random access memory 206 provides memory for use by CPU 205 in executing its various software programs while nonvolatile memory or storage device 207 may comprise a hard drive or other mass storage device providing storage for programs not in use or for other data generated or used in the course of gaming machine operation. Network interface 210 provides an interface to other components of a gaining system in which gaming machine 100 is included. In particular, network interface 210 provides an interface to a game server which controls certain aspects of the multiplayer, variable symbol shifting game as will be discussed below in connection with FIG. 3.

It should be noted that the invention is not limited to gaining machines employing the personal computer-type arrangement of processing devices and interfaces shown in example gaming machine 100. Other gaming machines through which a variable symbol shifting game is implemented may include one or more special purpose processing devices to perform the various processing steps for implementing the present invention. Unlike general purpose processing devices such as CPU 205, these special purpose processing devices may not employ operational program code to direct the various processing steps.

It should also be noted that the invention is not limited to gaming machines including only video display devices for conveying results. It is possible to implement a variable symbol shifting game within the scope of the present invention using an electro mechanical arrangement or even a purely mechanical arrangement for displaying the symbol shifting graphic, the selectable objects, and the display modifications resulting from the selection of the various selectable objects. However, the most preferred forms of the invention utilize one or more video display devices for displaying the symbol shifting graphic, the selectable objects, and the display modifications resulting from the selection of the various selectable objects. For example, a gaming machine suitable for providing a variable symbol shifting game may include a mechanical reel-type display rather than a video-type display device for displaying results in a primary game, and include a video display device for presenting the variable symbol shifting game as a bonus game. Thus, a gaming machine suitable for use in the present invention may have a structure similar to that shown for gaining machine 100 in FIG. 1, but with a mechanical reel-type display replacing primary video display device 104, and video display device 107 being used for displaying the symbol shifting graphic, the selectable objects, and the display modifications resulting from the selection of the various selectable objects.

Figure 3:
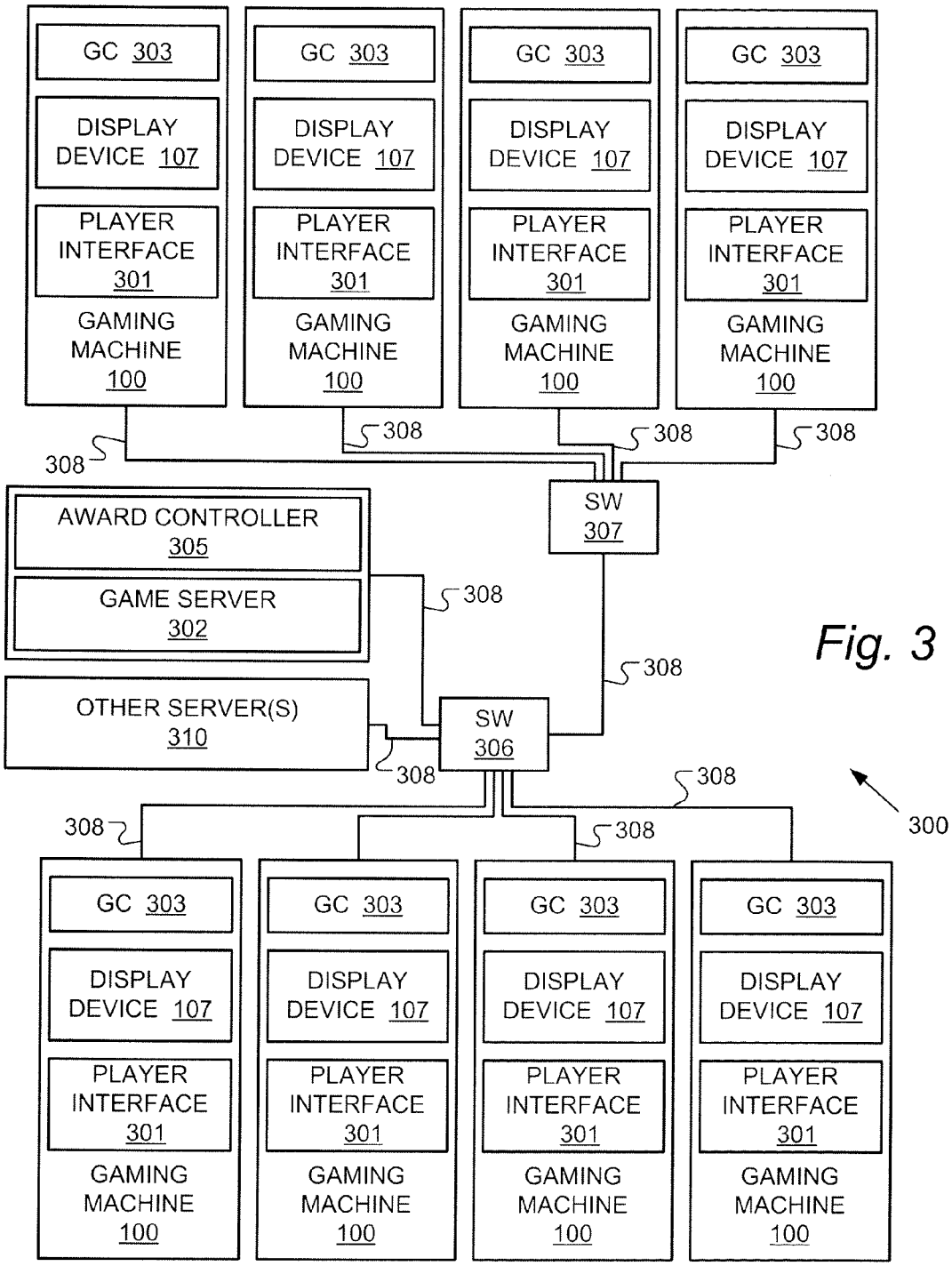
FIG. 3 is a block diagram showing a network arrangement connecting a number of gaming machines according to one embodiment of the present invention.

Referring now to FIG. 3, a gaming system 300 according to the present invention includes a number of gaining machines, each comprising a gaming machine 100 in this example implementation. For purposes of describing system 300, each gaming machine 100 in FIG. 3 is shown as including a video display device 107 and a player interface that may include buttons, switches, or other physical controls and/or touch screen controls as discussed above in connection with FIG. 1. This player interface is labeled 301 in FIG. 3. System 300 further includes a game server 302 and a respective game client 303 (abbreviated "GC" in FIG. 3) included with each respective gaming machine 100. In the form of the invention shown in FIG. 3, these two components, game server 302 and game client components 303, combine to implement a game control arrangement which will be described in detail below. System 300 also includes an award controller 305, which is shown in FIG. 3 as being associated with game server 302 to indicate that the two components may be implemented through a common data processing device/computer system. Gaming machines 100, game server 302, and award controller 305 are connected in a network communication arrangement including first and second network switches 306 and 307, connected together through various wired or wireless signal paths, all shown as communications links 308 in FIG. 3.

Each gaming machine 100, and particularly player interface 301 associated with each gaming machine, allows a player to make any inputs that may be required to make the respective gaming machine eligible for a symbol shifting game, and make a selection of selectable objects displayed at the respective gaming machine in the course of a symbol shifting game. Player interface 301 also allows a player at the gaming machine to initiate plays in a primary game available through the gaining machine in some implementations. The respective video display device 107 associated with each respective gaining machine 100 is used according to the invention to generate the graphic displays to show the various elements of a symbol shifting game at the respective gaming machine.

The game control arrangement made up of game server 302 and the respective game client 303 at a given gaming machine functions to control the respective video display device 107 for that gaming machine to display a symbol shifting symbol matrix according to the techniques described herein. In preferred embodiments, an award controller 305 is responsible for awarding prizes for a player's participation in a symbol shifting game, and maintaining progressive prize information in cases where the symbol shifting game offers one or more progressive prizes, for example as an optional bonus game.

Various implementations of the present invention employ various communications between game server 302 and the various gaming machines 100 included in system 300. The network arrangement made up of network switches 306 and 307, and the various communication links 308 shown in FIG. 3 is illustrated merely as an example of a suitable communications arrangement. The present invention is not limited to any particular communications arrangement for facilitating communications between game server 302 and various gaining machines 100. Any wired or wireless communication arrangement employing any suitable communications protocols (such as TCP/IP for example) may be used in an apparatus according to the invention.

The example system 300 shown in FIG. 3 shows two different groups of four gaming machines 100, but this is not limiting and typically a game server and award controller will service many more gaming machines. FIG. 3 shows other server(s) 310 included in the network. This illustrated "other server(s)" element 310 may include one or more data processing devices for performing various functions related to games conducted through system 300 and any other games that may be available to players through gaming machines 100. For example, apparatus 300 may provide support for cashless gaining or various forms of mixed cash/cashless gaining through the various gaming machines 100. In this example, one more other servers 310 will be included in apparatus 300 for supporting these types of wagering and payout systems. As another example, the various gaming machines 100 included in system 300 may allow players to participate in a game (primary game) other than a symbol shifting game, and this other game may rely on a result identified at or in cooperation with a device that is remote from the gaining machines. In this example, another server 310 may be included in the system for identifying results for the primary game and communicating those results to the various gaining machines 100 as necessary. Generally, the other server(s) 310 shown in FIG. 3 are shown only to indicate that numerous other components may be included along with the elements that participate in providing symbol shifting games according to the present invention. Other server(s) 310 may provide record keeping, player tracking, accounting, or result identifying services, or any other services that may be useful or necessary in a gaining system.

Figure 4:
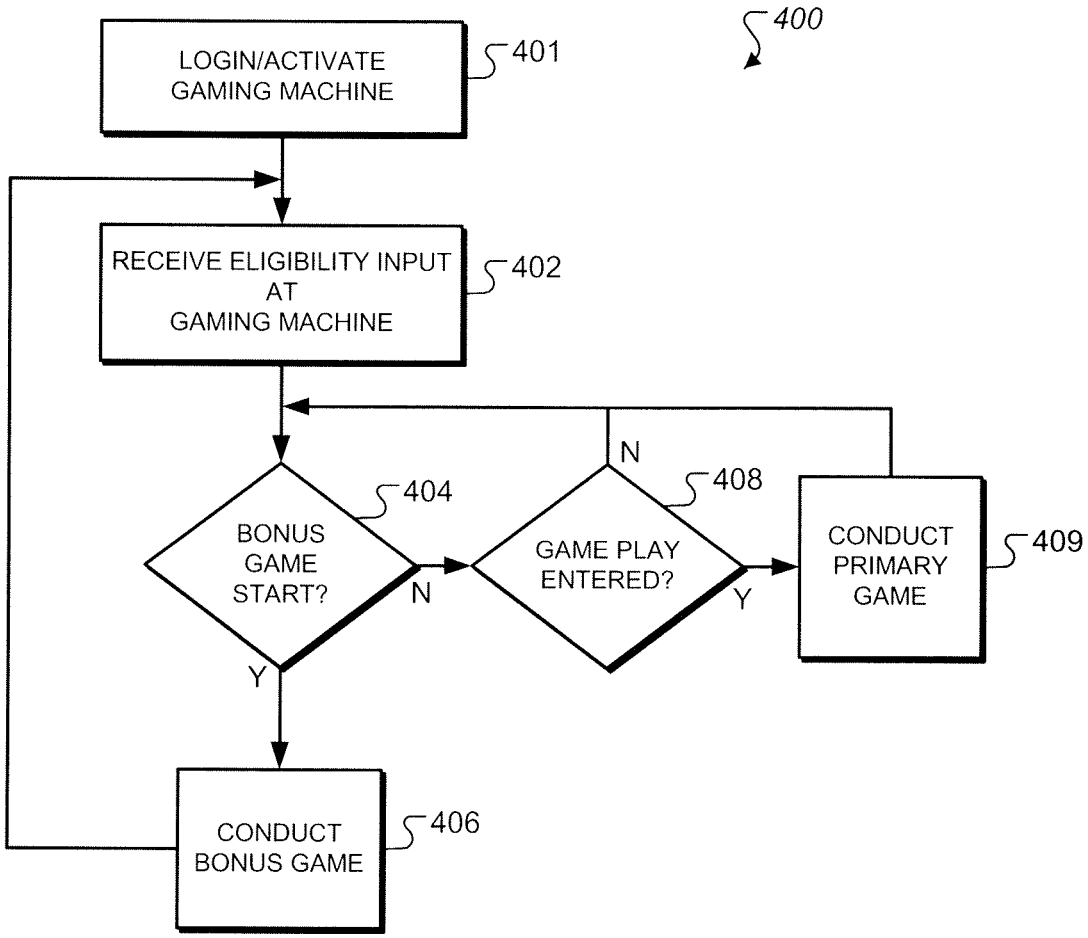
FIG. 4 is a flow chart showing the general process of play at a gaining machine that includes a variable symbol shifting bonus according to one embodiment of the invention.

FIG. 4 shows a process 400 that may be performed at the various gaming machines 100 included in gaming system 300 shown in FIG. 3. In particular, process 400 illustrates the interaction between a primary game that may be available at a respective gaming machine 100, and a variable symbol shifting game implemented as a bonus game through the gaining machine. Once the player logs in at gaming machine 100 or otherwise activates the gaming machine as indicated at process block 401, the player may make a suitable eligibility input at the gaming machine as indicated at process block 402. If a bonus game is started as indicated by a positive outcome at decision block 404, the process proceeds to conduct a bonus game as indicated at process block 406. This bonus game may comprise a symbol shifting game according to the present invention. Once the bonus game is completed, the process loops back to receive any other eligibility input as necessary. If the bonus game is not starting for the respective gaming machine 100 as indicated by a negative outcome at decision block 404, the process proceeds to conduct a primary game as indicated at process block 409 in the event that a primary game initiating input, that is, a "game play," has been entered as indicated by a positive outcome at decision block 408. If a game play has not been entered at the gaining machine, the process then loops back to determine if the bonus game is to start.

Process 400 shown in FIG. 4 is a simplified process included in this disclosure to indicate that gaming machine 100 may require an eligibility input in order to be entitled to participate in a symbol shifting game according to the present invention. In one preferred embodiment, a gaming machine may be made eligible for the symbol shifting game by placing a suitable side bet at the gaming machine. In this embodiment, a particular side bet entered at the respective gaining machine 100 makes the gaming machine eligible for a bonus game that starts within a fixed period of time after the side bet is made. The respective gaining machine 100 may maintain a countdown timer showing the time of eligibility remaining. The respective gaming machine 100 may include a component that monitors the eligibility time remaining and, when the eligibility time is about to expire, produce a suitable prompt for the player providing a suitable indication to that effect and providing the player an opportunity to renew the eligibility by making another side bet.

It will be appreciated by those skilled in the art that eligibility may be handled in a number of ways within the scope of the present invention. Also, some forms of the invention may not require a separate eligibility input but instead may make a given gaming machine eligible in response to a particular bet level in the primary game. In yet other forms of the invention, all gaming machines may be automatically eligible for participation in a symbol shifting game, and no eligibility inputs are necessary to participate in such a game.

It should be noted that process 400 in FIG. 4 assumes that the symbol shifting game is conducted as a bonus game at a gaming machine that also offers a primary game that the player may play in between symbol shifting games. However, the invention is not limited to the implementation of a symbol shifting game as a bonus game. In particular, a symbol shifting game may be implemented as a primary game at gaming machine 100, and may be offered with or without any bonus or secondary games.

Figure 5:
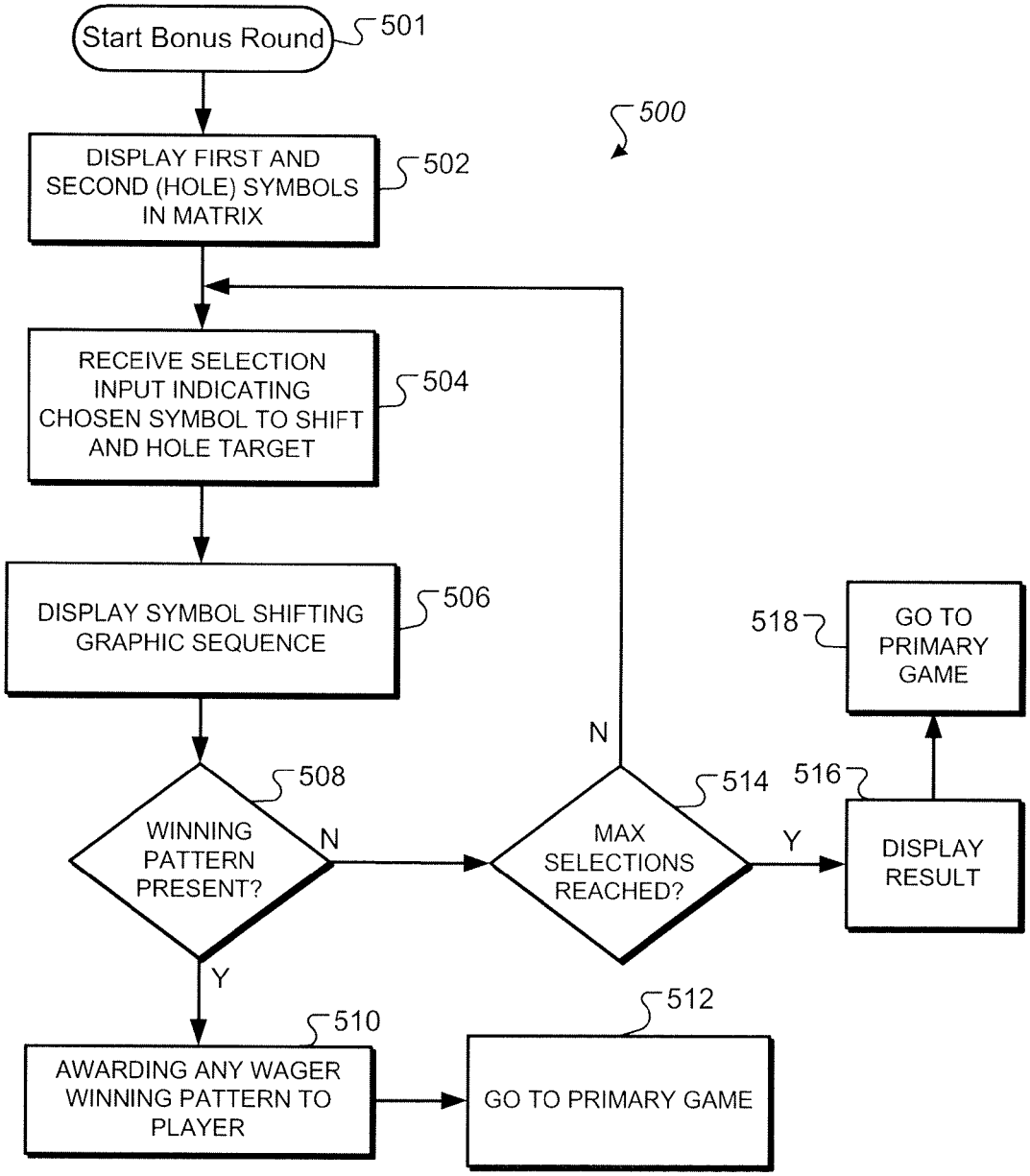
FIG. 5 is a flow chart showing the process at a particular gaming machine during the conduct of a variable symbol shifting bonus game according to one embodiment of the invention.

FIG. 5 shows a process 500 that may be performed at a respective gaming machine 100 during the conduct of a symbol shifting game, whether conducted as a bonus game as indicated at block 406 in FIG. 4 or otherwise. In process 500, the respective gaming machine 100 receives an initial display command at the start of a particular symbol shifting game. After receiving the initial display command as indicated at process block 501, gaining machine 100 displays the first and second types of symbols, that is the gaming symbols and hole symbols, in the symbol matrix at the gaming machine as indicated at process block 502. That is, either the respective gaming machine 100 or gaming server 302 causes the desired display device(s) at the gaming machine to display the first and second hole symbols in the matrix. In a preferred embodiment this is done by portraying the matrix of symbol locations as simulated spinning reels, with columns of symbol locations moving vertically to depict a spinning motion like a classic reel slot machine well known in the art.

After block 502, the process waits for gaining machine 100 to return the player selection input at block 504. This input returned from gaming machine 100 indicates one of the gaming symbols (first type) to be shifted into the location of a hole symbol. In this manner, the player is provided a chance to try to improve the position of symbols in the matrix in order to form a winning pattern. One example symbol matrix at this stage is provided in FIG. 9 below for reference. In response to a prompt, the player selects a gaming symbol to move to an adjacent hole symbol. In some embodiments, merely selecting a gaming symbol may be an ambiguous input because a particular gaming symbol may be adjacent to more than one hole symbol. To provide an accurate choice in such case, gaining symbols that are adjacent to multiple hole symbols may be provided with selectable arrow indicators to receive the player input. In some cases arrows or other such active areas are presented for all of the moveable symbols. The player input preferably occurs through touching the actual symbol, arrow, or other active area, using the gaming machine touchscreen.

After receiving the player input from gaming machine 100 in block 504 of process 500, the process 500 then causes gaming machine 100 to display the chosen symbol graphic shift sequence in the symbol matrix as indicated in process block 506. That is, the gaming machine then displays the symbols shift chosen by the player. The process then checks to see if a winning pattern is present as indicated in decision block 508. Winning patterns are preferably formed by gaming symbols and not hole symbols. If a winning combination is not detected at block 508, process 500 then checks to see if the maximum number of selections has been reached as indicated in decision block 514. If the maximum number of selections has not been reached as indicated in decision block 514, process 500 then returns to block 504 to wait for another selection input by the player in the symbol matrix. Selections continue until the maximum selections are reached at decision block 514, or a winning pattern is detected at block 508.

If the maximum number of selections has been reached back at block 514, process 500 causes gaming machine 100 to display the results of the gameplay as indicated in block 516. Process 500 then returns to the primary game as indicated in block 518.

In the event of a winning combination being detected at block 508, process 500 awards any wager winnings to the player if winning patterns are achieved, as indicated in block 510. After awarding the wager winnings in block 510, process 500 returns to the primary game as indicated in block 512.

Process 500 shown in FIG. 5 represents one preferred process conducted at a respective gaming machine 100 for an implementation of a symbol shifting game as implemented through a gaming system as shown in FIG. 3. Other versions use a different flowchart which only allows one selection by the player, and conducts the remaining symbol shifting steps under the control of the gaining machine, automatically.

In this preferred form of the invention, the functions of the gaining machine in the symbol shifting game all relate producing various displays and modifications to the graphic displays in response to information received from game server 302. Other forms of symbol shifting games within the scope of the present invention may distribute functions differently across the network. In particular, rather than rely exclusively on information provided by game server 302 as indicated in process 500, the respective gaining machine 100 may act on at least some information available to the gaining machine without any communication with the game server.

The type of information received in the initial display command as indicated at process block 501 may include any initial information necessary to allow the respective gaming machine 100 to display the desired symbol shifting graphic in its initial state and to display the selectable objects in their initial state according to process block 502.

Figure 6:
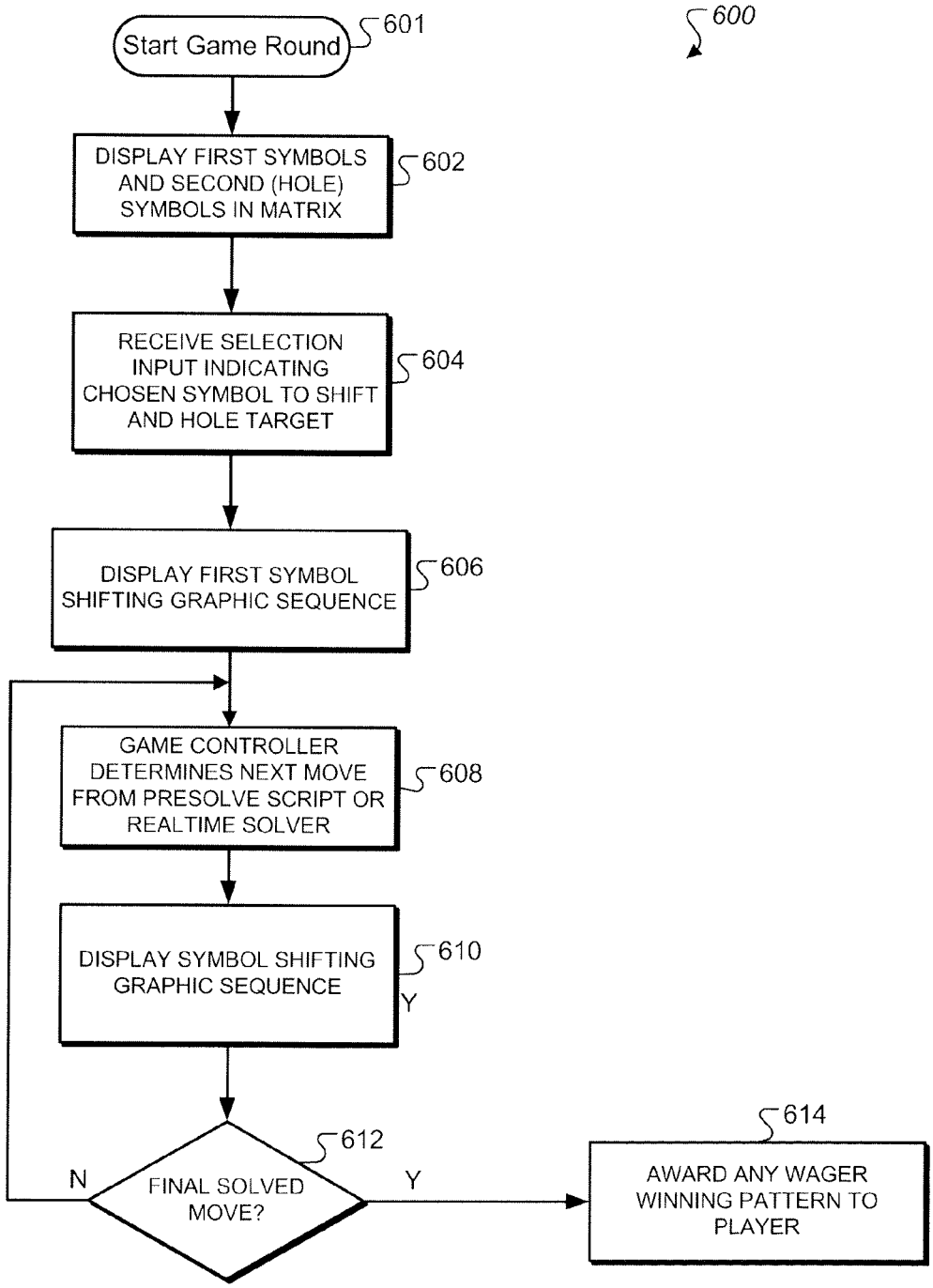
FIG. 6 is a flow chart showing another variation of a gaining machine process in the conduct of a variable symbol shifting game according to another embodiment of the invention.

FIG. 6 shows a gaming process according to another embodiment, in which the symbol shifting game is provided as a base game for a wagering slot machine. This process also uses only one selection by the player, and provides the remaining moves or symbol shifts automatically.

Referring to the depicted process 600, the respective gaming machine 100 receives an initial display command at the start of a particular symbol shifting game. After receiving the initial display command as process block 601 in response to a player wager input, gaming machine 100 displays the first and second types of symbols, that is the gaming symbols and hole symbols in the symbol matrix at the gaming machine as indicated at process block 602.

Next, the process prompts for player input in moving a gaming symbol to try and solve the matrix. The player input is provided indicating a desired symbol and direction in which the player wants that symbol to shift, as indicated in block 604. Using the input, process 600 causes gaming machine 100 to display a first player chosen symbol graphic shift sequence in the symbol matrix as indicated in block 606.

After process 600 displays the first player chosen symbol graphic shift sequence in the symbol matrix as indicated in block 606, the process may check to see if a winning combination has been reached, or if maximum moves have been reached (optional step not shown). Some versions will use symbol matrixes that require a minimum number of moves to reach a winning pattern, or use pre-solved sets of moves as further described below, and therefore do not need to check for a winning pattern here. Next at block 608, the process determines the next move as indicated in block 608. The next move is a subsequent shifting of yet another gaming symbol into a hole in the symbol matrix. The move may either be determined in one preferred version, by a pre-solved sequence that may be stored in a script, or the move may be determined by use of a real-time solver implemented as a software module. In any event, after the process has determined the next move, it then causes gaming machine 100 to display a graphic sequence implementing the next move as an animated shifting of a gaming symbol into a hole, as indicated in block 610.

After, or while, displaying the next move the process checks to see if a winning combination or if maximum moves have been reached, as indicated in block 612. In the event of neither a winning combination nor a maximum moves reached as indicated in block 612, process 600 returns to block 608 where the gaming controller determines the next move. In the event of maximum moves being reached as indicated at block 612, then the process causes the gaming machine to award any wager winning, responsive to the presence of a winning pattern, as indicated at block 614. The determination of whether the maximum number of moves is reached may vary between individual game rounds or individual pre-solved data sets (described below). For example, some pre-solved data sets may include different numbers of moves, and so the final move will occur after a different number of iterations through the loop shown toward the end of the process in FIG. 6. In versions that use a real-time solver to produce moves in response to the player's first chosen move, the solver is preferably configured to read a maximum number of moves associated with the stored configuration data indicating the initial state of the symbol matrix. That is, certain initial display combinations (what symbols arc displayed and where the symbols and holes are displayed) will have higher potential for awards and may have a lower limit on the maximum number of moves allowed than other initial display combinations.

Figure 7:
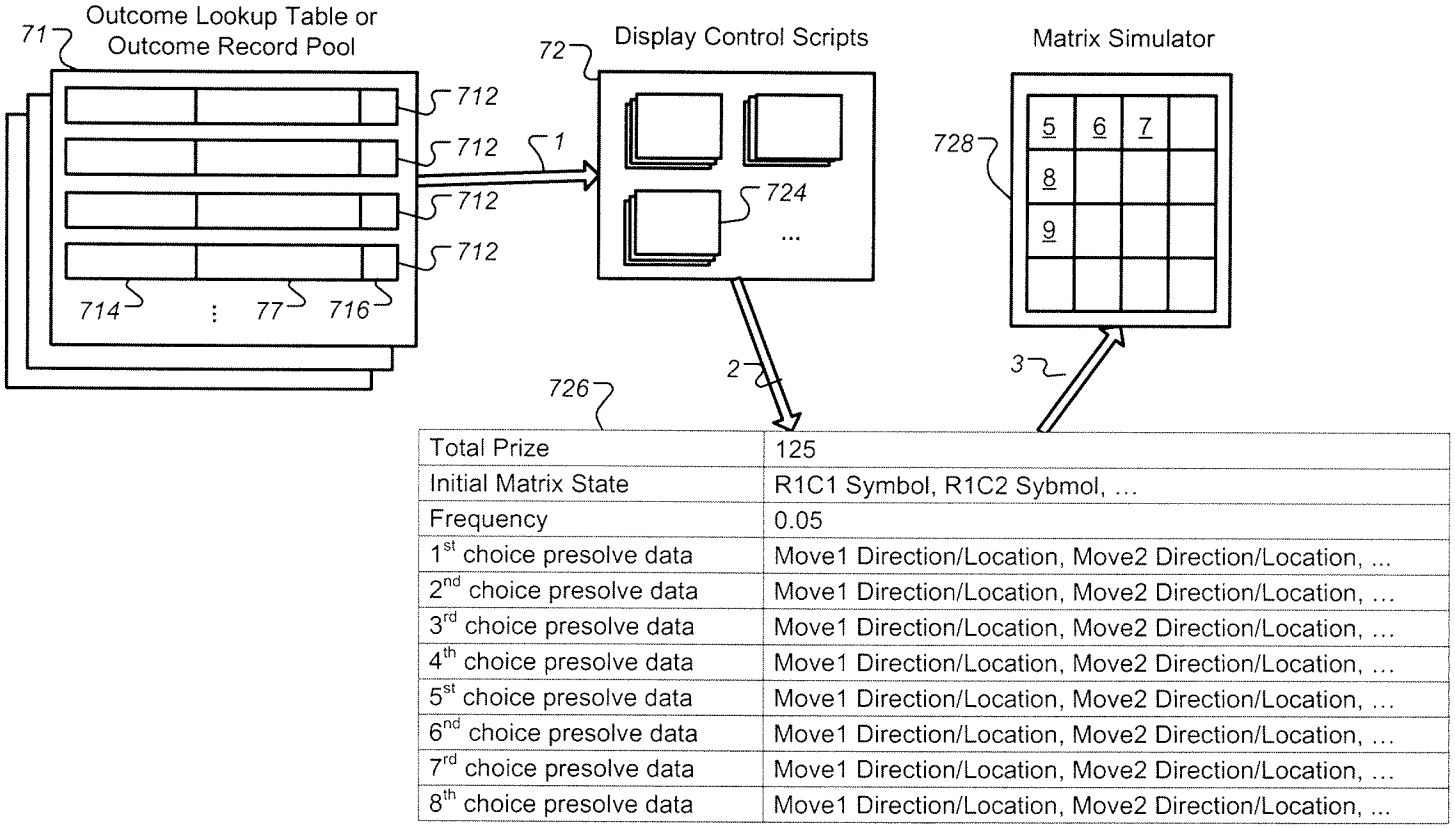
FIG. 7 shows a sequence of data structures that may be used in a bonus game according to some embodiments of the invention.

FIG. 7 shows a sequence of data structures that may be used in a symbol shifting game according to some embodiments of the invention. The depicted data structures are used to generate matrix shifting sequences and display the results. This is merely one example implementation, and one of skill in the art will understand from the remaining disclosure that many other implementations are possible to achieve similar results. The arrows in FIG. 7 depict the order in which the various data structures are used during the course of a game. Similar data structures may be used in both the case where the gaming machine produces results for base games played thereon, and where the gaining machine instead sends game play requests and player selection inputs to the server, which sends game results or display instructions back. Preferably a server provides the outcome for a game, while the gaining machine handles player interaction and display of shifting symbols in the symbol matrix.

Regardless of where the results are generated, typically the generation follows one of two processes. In the first process, a generated random number is used to index a table and lookup an outcome in the table. In such a version, the outcomes are stored in a lookup table 71 which is indexed by the random number to provide suitable distributed, randomly-selected results. The lookup table has a number of outcome entries/record 712, each with an index 714, a prize amount 77 in credits, and a progressive entry ticket field 716. The outcome entry may have other data fields to control other parts of the game. The progressive entry ticket field 716 indicates whether the record outcome contains one or more progressive game entry tickets.

The second available process of game outcome generation, as opposed to a game outcome determined by random number, is to use an outcome record pool of predetermined outcomes in place of the lookup table 71. In those games, an outcome record 712 (rather than a lookup table entry) is chosen from record pool 71 in response to a game play request. Still other embodiments may use a server-hosted bingo game with multiple game play requests participating as bingo cards, the bingo patterns determining prize outcomes. Referring to an outcome record pool 71, such record pool may be stored at a game server and accessed with game play requests from the gaming machine, or the server may allocate pools of outcome records to be stored and used locally at a gaming machine. In either case, the depicted game sequence provides an outcome record 712 in response to a player game play request, such as pushing the spin button to make a wager. An outcome record 712 is chosen from the pool either randomly or from a randomly-organized queue. The chosen record has a record identifier 714 (rather than an index 714 as used in the first embodiment option for FIG. 7), a prize amount 77 in credits, and a progressive entry ticket field 716. The outcome record data object may have other data fields to control other parts of the game. The progressive entry ticket field 716 indicates whether one or more entry tickets are earned for the progressive game. A preferred embodiment displays a designated outcome in the base game to indicate that a progressive entry ticket has been earned. Also, an earned ticket causes a multiplier to be stored based on the value of the player's side bet or bet participation level. The multipliers may accumulate over time.

The preferred process to display base game results is as follows. To start updating the base game display, the gaming machine display controller uses prize amount field 77 to select a display control script from a group of scripts 72. This step is indicated by the arrow labeled "1." The selection process at arrow 1 may be made in any suitable manner that selects a display control script to display the base bonus outcome based on the outcome record. The selected script is used to control the display to provide an exciting series of events in the free-spin bonus round. A preferred control sequence proceeds as follows. The gaming machine presentation controller uses prize amount 77 to select a set 724 of display control scripts from script group 72. Group 72 includes multiple sets. The selected set 724 includes, in this example version, all display control scripts that have a total prize outcome equal to prize amount 77. A separate group may be provided to display entry-ticket winning outcomes for each prize amount, or a separate display area or sequence may be provided for displaying progressive entry ticket winning results. Set 724 preferably includes many display control scripts each of which uses a different set of symbols for the display matrix to indicate the total prize amount. This helps provide variety and excitement to the game. For example, suppose the selected game outcome entry or record 712 is a winning result having a prize amount 77 indicating a 125-credit prize. The display controller looks to the group of display control scripts 72 and finds the set of scripts 724 that all have a total prize value of 125 credits. The display controller then randomly selects from this set, preferably by generating a random number and using it as an index to identify a particular script. Any suitable random selection or randomization step may be used, or a predetermined sequence may also be used if it is long enough that no pattern is discernable during player use of the gaming machine. In any event, a single display control script 726 is chosen from the set 724 for use in displaying the base game results to the player. This is indicated by the arrow marked "2."

A display control script 726 chosen at arrow 2 for the free spin bonus round includes, in this version, the depicted data fields. The fields are shown with field name on the left and an example value on the right. Other fields may also be included, and some fields are not absolutely necessary. This version includes the total prize field in the display control script for tracking purposes. Script 726 contains an Initial Matrix State field identifying each symbol in the display matrix as it is initially displayed. The Frequency field indicates a number indicating the hit frequency or probability that this particular script will be selected from set 724. The depicted example shows a 0.05 Frequency value, indicating that this script will be shown 5% of the time that a total prize of 125 credits is awarded in the base game. This hit frequency is preferably controlled through selection by an evenly-distributed random number, but may be enforced by other suitable methods, including random number based methods or methods that rigidly enforce the hit frequency.

The presentation controller employs script 726 to control what symbols are shown in what locations in the symbol matrix, including a first type, gaming symbols of various types used in the game, and a second type, hole symbols, which indicate that gaining symbols may move into the hole symbol position. In a preferred game, the initial symbols filling the matrix are created after a simulated reel spin. In such case, the reels are simulated as having symbols of the first and second type, which come to a stop position as the simulated reel spin is completed. In the depicted script, this is caused by the Initial Matrix State field, which acts to control the matrix simulator, as shown by the arrow marked "3," which points to matrix simulator 728. Simulator 728 simulates spinning slot-machine reels and displays resulting symbols. Each simulated reel is modeled as a set of reel-symbols arranged in a circle. In the preferred game, one symbol from each simulated reel is shown at a time (although other games may use multi-symbol reels, such as 3 or 5 symbol reels). While the reel simulator may appear to players to be five 3-symbol reels, the simulator actually includes 7 simulated reels, each showing a single position (uni-symbol reels). In the depicted reel simulator 728, for example, each square 5, 6, and 7 and so on represents a single symbol displayed from a different reel, and squares 8 and 9 and so on also represent a single-symbol reel display. The simulated reels are controlled by their position, which is designated by which symbol place on the reel is presented at the center space in the three vertical symbol spaces shown in the 5 reels.

After matrix simulator 728 shows the matrix in its initial state, the gaming controller then displays a prompt and other appropriate indicators on the symbol matrix for the player to choose a symbol of the first type, that is a gaming symbol, to be moved into the location of a designated hole symbol. For each possible choice that is available for the player to make, in this embodiment, script 726 provides a set of pre-solved data which tells the matrix simulator what subsequent moves are in order to solve the matrix and achieve a game-winning pattern that produces the prize shown in the total prize field. In the depicted example, suppose there are eight possible choices the player could make when presented with the matrix in its initial state. This means that there are eight possible moves that could be made on the display matrix by moving a gaming symbol into an adjacent hole. For example if there are two holes, each surrounded by four symbols, then eight possible moves are provided. For each of those possible moves, script 726 stores a set of subsequent moves. These eight sets are shown labeled as "$1^{st}$ choice presolve data" through "$8^{th}$ choice presolve data." Each set of pre-solved data includes multiple moves that will be taken automatically to solve the matrix, after the player makes their initial choice. Each move is stored, preferably, as a location and a direction. The pre-solved data sets 1-8 may have different numbers of moves. For example the $1^{st}$ choice pre-solved data may contain five moves, while the $2^{nd}$ may contain seven moves.

In some embodiments, the final state of the matrix after all of the moves in a particular pre-solved data set have been executed may vary between the different pre-solved data sets. In the depicted embodiment in FIG. 7, the player's choice cannot change the fact that they have already been assigned an outcome for this game, and cannot change the prize, in this example 125 credits, that is awarded. However, other embodiments such as that in FIG. 8, may provide that the player's choice can in fact affect the prize outcome of the game. With regard again to FIG. 7, while the player's choice does not affect the game outcome in this embodiment, it can affect the final state of the matrix. For example the $1^{st}$ choice pre-solved data set may award the 125-credit prize by forming a winning pattern of three symbols arranged horizontally in a certain payline of matrix simulator 728. Another choice, say for example the $4^{th}$ pre-solved data set which would be selected by the player by choosing the particular first move that is associated with that data set, might award the 125-credit prize in a different manner, such as, for example, producing two winning patterns along two different paylines in matrix 728, each entitled to a smaller prize.

Figure 8:
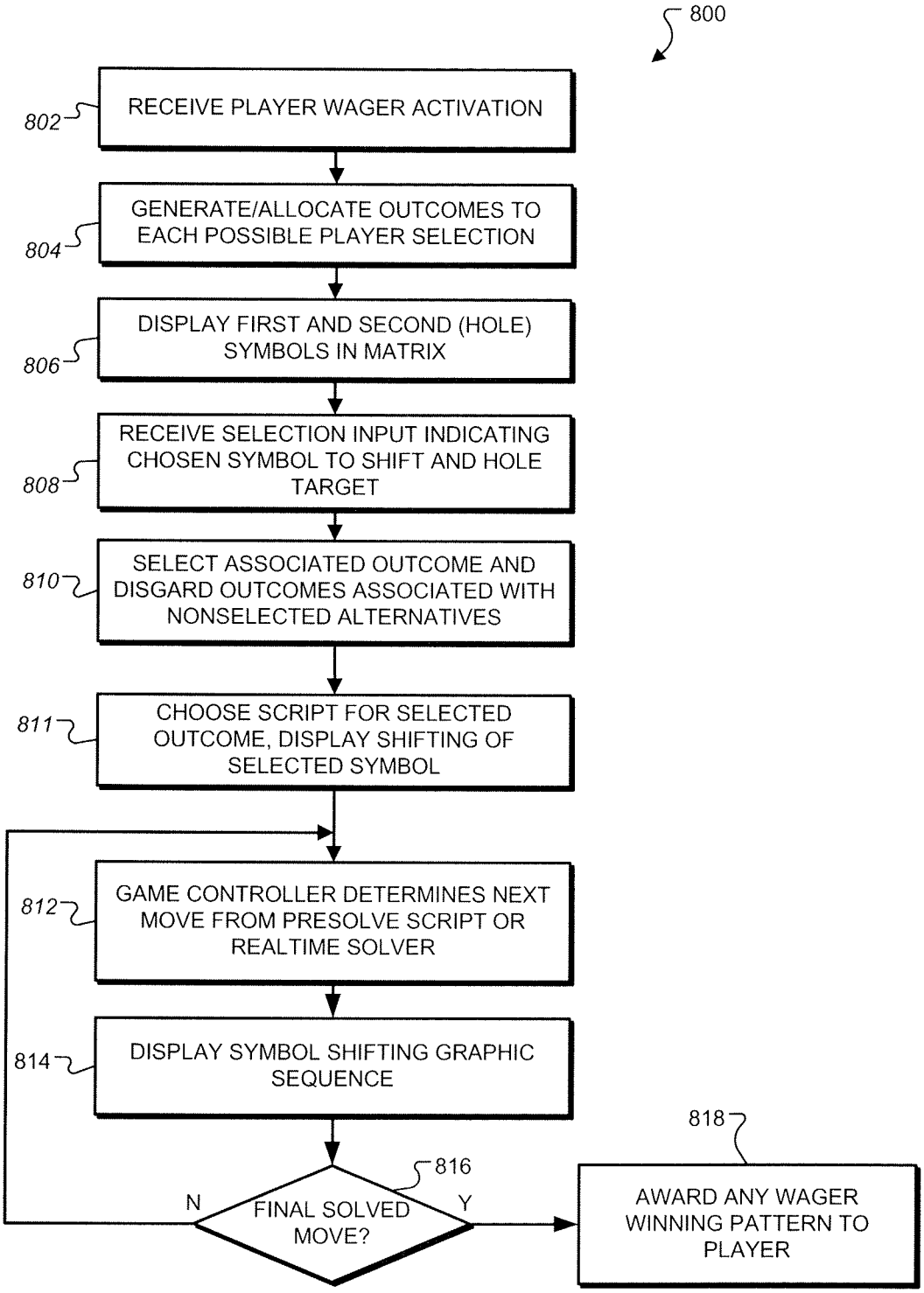
FIG. 8 is a flow chart showing another variation of a game process in which the player's choice affects the game outcome selected.

FIG. 8 shows a gaming process used to conduct a game according to another embodiment. The gaming process is used to generate an initial display, receive player input in the game to select an initial move to solve the matrix, and then select an outcome based on that initial move. The process then displays the results by moving symbols to solve the matrix and showing the moves on the gaming machine display.

Initially process 800 waits for activation of gaming machines 101. This activation will also have associated wager information included, as indicated in block 802. After process 800 receives gaming activation and wager information, then the process causes game server 302 to generate and allocate player outcomes to each individual player selection as indicated in block 804. In this version, the game server does not choose a single outcome that can be used at the beginning of the game (the wager), but instead produces multiple outcomes which may be employed during the game, or may expire unused at the end of the game. The multiple outcomes are used as follows.

At block 806, the process displays an initial symbol matrix to the player, which includes gaming symbols and hole symbols. This step is preferably conducted under control of the gaming machine, without intervention from the gaming server. In a preferred embodiment this step displays simulated reels, which include the gaming symbols and the hole symbols while spinning, and come to rest displaying the gaming symbol matrix and its initial matrix state. While reel simulations are preferred for this game, that is not limiting and various other embodiments to use other graphic schemes to portray a graphic sequence which initializes the display matrix. For example, another embodiment uses multiple shifting symbols which appear to shift onto the screen with sideways or vertical movements, and shift among each other, and then stabilize to display the initial matrix state of gaming and hole symbols.

After process 800 displays first and second hole symbols in the symbol matrix as indicated in block 806, the process then waits for input from gaming machine 101 as indicated in block 808. This is preferably made by selections on the touch-screen display from the symbol matrix as described herein. The information provided to the process as a result of this selection contains the player input for which chosen symbol to shift as well as the target hole symbol.

After receiving the input at block 808, process 800 causes game server 302 to disregard the outcomes associated with the nonselected alternatives as indicated in block 810. This block also selects the outcome associated with the selection made by the player. In this example game, each possible selection presented to the player in the initial matrix state, that is, each possible move to the player can take to begin solving the matrix, is linked to a single game outcome already generated or allocated, and associated with that selection back at block 804.

At block 811, the process next displays the symbol, identified by the player's selection, shifting into its target hole position. This block, in a preferred embodiment, also includes selecting a script for use in displaying the result chosen for the current game round. A preferred script in this embodiment resembled script depicted in FIG. 7, but rather than having a set of pre-solved data each associated with a possible choice that a player can make, a script of the embodiment of FIG. 8 will instead include only one set of pre-solved data, because the script is chosen after the player's first move is selected, and based on the gaming result selected for the current game.

From this point, that is from block 811 to depicted block 812, in a preferred embodiment the game controller determines the next moves needed to solve the matrix and displays them automatically in a sequence. The sequence includes blocks 812, 814, and 816, which sequence is repeated until the matrix is solved. At block 812, the game controller determines the next move based on pre-solved data contained in the script. A real-time solver may also be used. Such an alternative embodiment includes a real-time solver software module, preferably executing on the gaming machine, which employs as an input the prize for the current gaining result and the matrix state after the first move selected by the player. The real-time solver module then provides the subsequent moves to solve the matrix and provides the desired winning pattern (s) within certain constraints as to how many moves may be used as a minimum and maximum. However, preferably a pre-solved data set is used. After determining each move based on pre-solved script or the real-time solver, the process displays a symbol-shifting graphic sequence needed to implement the move on the symbol matrix at block 814.

At block 816, the process determines if a winning combination has been reached, or if maximum moves has been reached. If neither a winning combination nor maximum moves has been reached, then the process loops back to determine the next move as indicated in block 812. If the process determines that either a winning combination or maximum moves has been reached, then the process moves on to block 818 and award any wager winnings to the player. Note that block 818 includes no prize awarded for those outcomes that do not contain a prize. In some games, a large percentage of outcomes will not pay an award.

Figure 9:
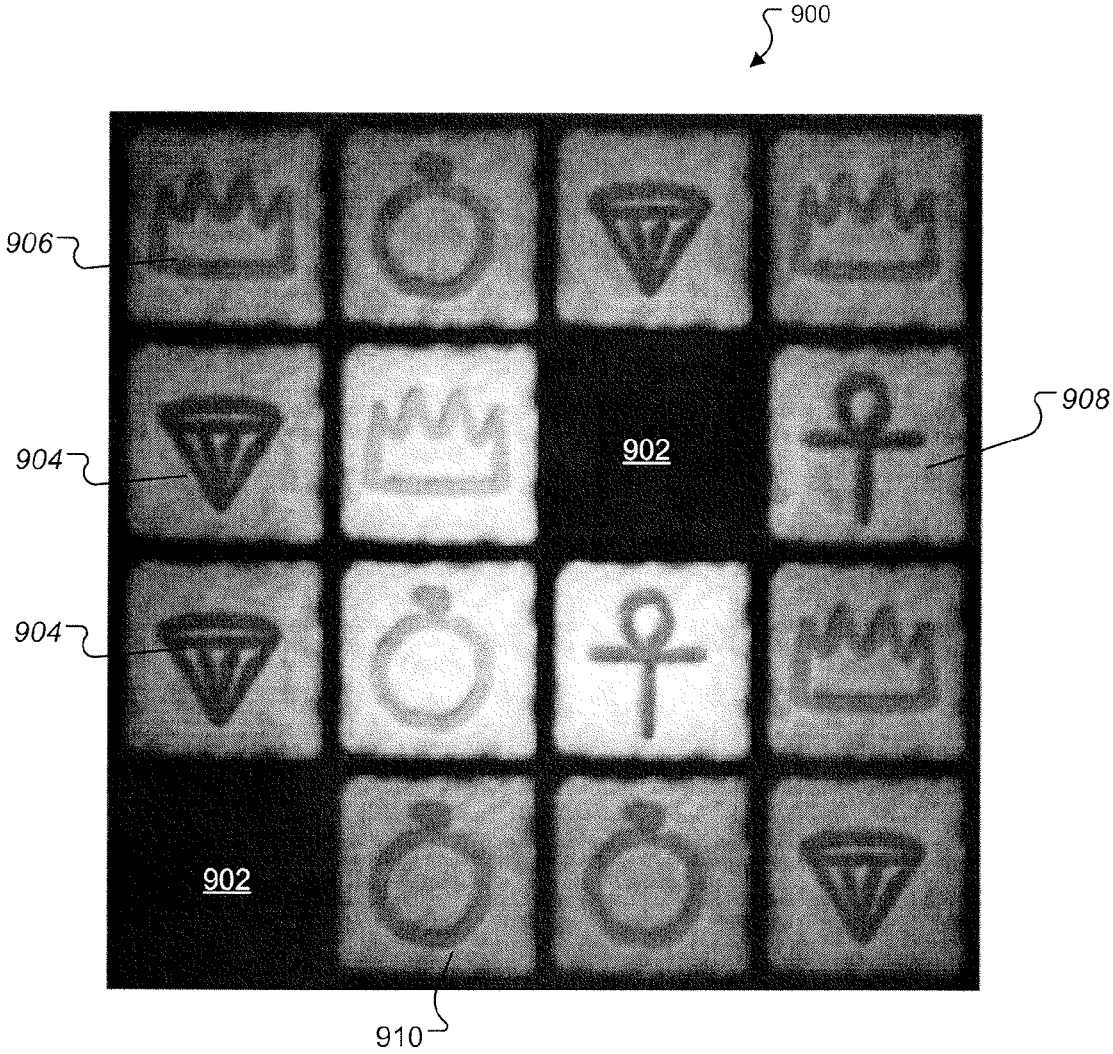
FIG. 9 is a representation of a graphic display showing an initial status of the symbol matrix with gaining symbols and hole symbols according to one embodiment of the invention.

FIG. 9 shows one example symbol matrix and its initial position according to one embodiment. Symbol matrix 900 includes two types of symbols, the first being gaming symbols 904, 906, 908, and 910, which in this example embodiment have an archaeological theme. The second type of symbols in symbol matrix 900 are hole symbols 902. As depicted, in this example hole symbols 902 are shown as blank spaces with no discernible symbol present, preferably with a black background. In other embodiments, the hole symbols may actually include a graphic symbol of some type to indicate its presence.

The depicted symbol matrix 900 is shown in its initial state after the player presses the wager button and the reels (vertical columns of symbols) spin or some other randomization process occurs to visually indicate that the slot machine game round has been activated.

Other embodiments may show an initial display without any hole symbols 902, and may instead create the hole symbols by providing the player with a choice to select and remove symbols from the symbol matrix. The removed symbol may then be replaced with a hole symbol, and the game may proceed according to the process starting at block 608 in FIG. 6. That is, the initial choice made by the player may be to remove a symbol of the first type (gaming symbol), and replace it with a symbol of the second type (hole symbol). The gaming controller may then choose subsequent gaming symbols to shift into the hole symbol locations.

Figure 10:
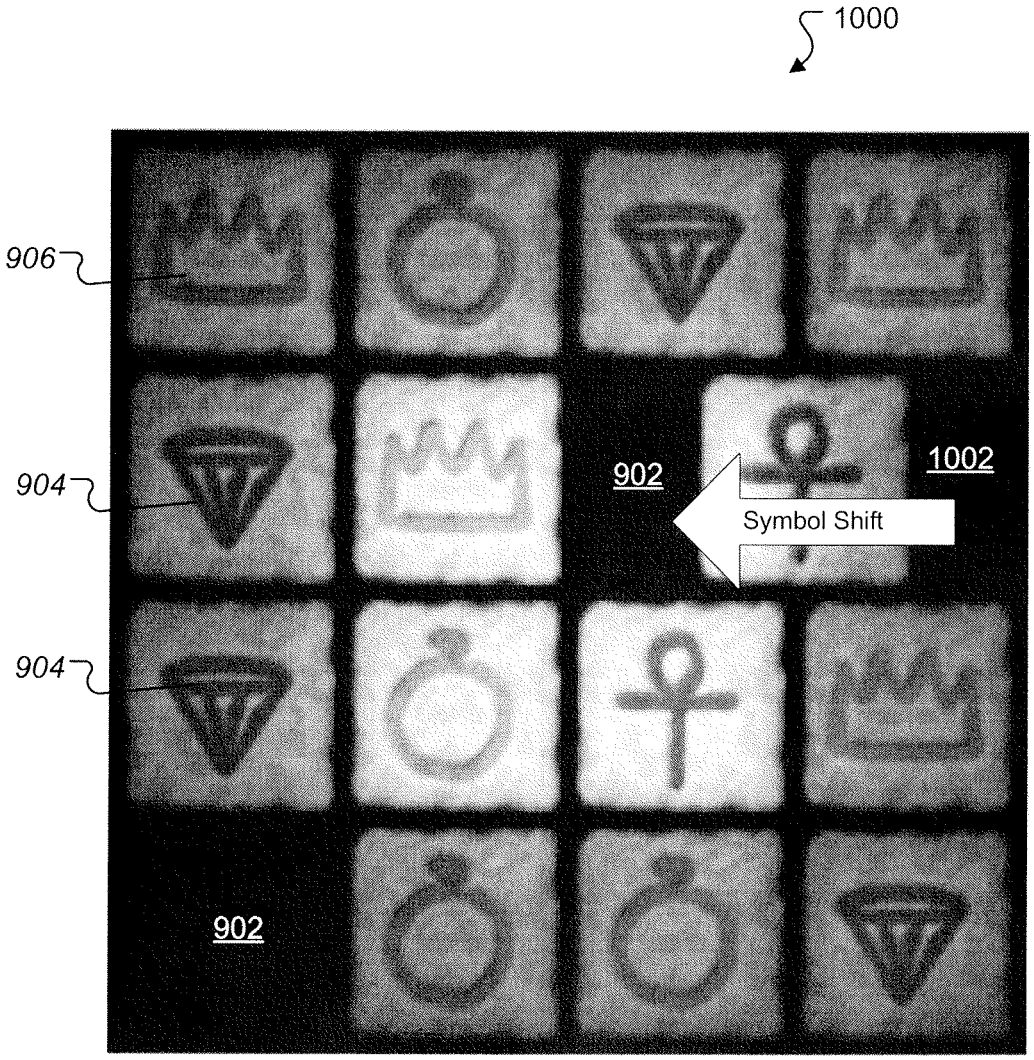
FIG. 10 shows an example symbol matrix with a shifting symbol occurring after the matrix shown in FIG. 9.

FIG. 10 shows an example symbol matrix with a shifting symbol occurring after the matrix shown in FIG. 9. In this depicted sequence, gaming symbol 908 from FIG. 9 has been selected by the player, and is now being shifted. The shift is indicated by the arrow marked "symbol shift". The shifting symbol is moving to fill the space of the adjacent hole symbol 902, thus leaving a new hole symbol 1002 and the space originally occupied by the shifting symbol. In a preferred game, the shift is shown with a graphic animated sequence in which the symbol slides to its new position over the course of a perceptible amount of time to a player. For example, each shift of the symbol may take around one half second, or more, with the appropriate speed of the symbol shift being determined to provide a movement that the player watching the symbol matrix would be able to notice and observe. In the preferred game, every symbol shift, whether selected by the player or initiated automatically by the gaming controller, is displayed with such an intimated shifting of the game symbols. According to the rules of the preferred game, gaming symbols can only shift into hole symbols, it cannot exchange places or shift into or over other symbols. As previously discussed, a prompt may be displayed to the player telling them to choose a gaming symbol to shift into a hole symbol, with the goal of forming a winning pattern or combination of gaming symbols, as will be explained in the game prize table preferably presented on the screen beside the symbol matrix or available from help screens in the game.

Figure 11:
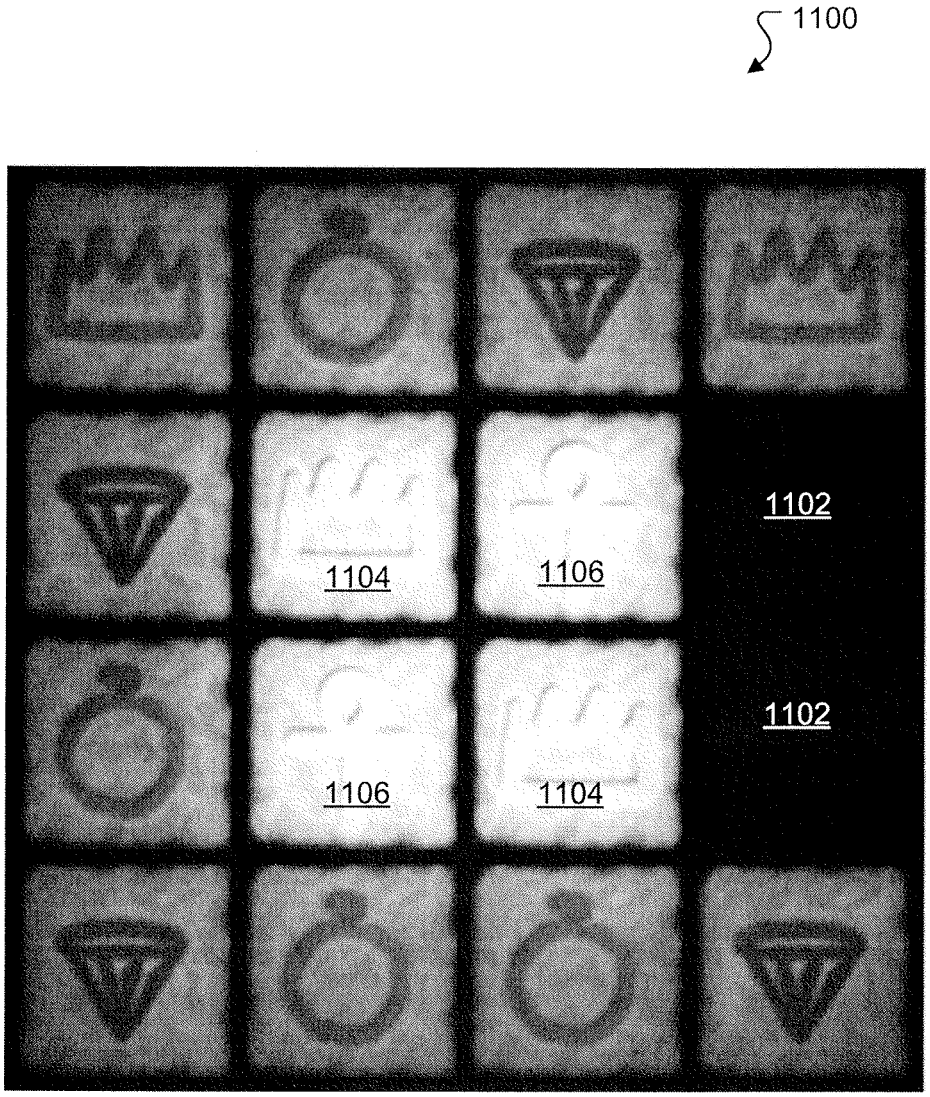
FIG. 11 shows a symbol matrix of FIGS. 9 and 10, after all symbol shifting has occurred in the game, and a winning combination of symbols has been formed.

FIG. 11 shows a symbol matrix of FIGS. 9 and 10, after all symbol shifting has occurred in the game, and a winning combination of symbols has been formed. The depicted symbol matrix 1100 still includes gaming symbols of the first symbol type including symbols 1104 and 1106, and hole symbols (second symbol type) 1102, although the hole symbols have moved from their original location as shown in FIG. 9. As shown, two crown symbols 1104 and two cross symbols 1106 are highlighted in the center of symbol matrix 1100 to indicate that they form a winning combination. A winning combination is any defined grouping or line of gaming symbols, and can include scatter symbol combinations as are typically known in the art. If symbol matrix 1100 is used in a reel-based game like some examples discussed herein, pay lines may be defined through the symbol matrix and may have visual indicators along the edges of the simple matrix. In such case, winning patterns may not only be highlighted, but may include an animation of the winning line along which the winning pattern is formed, as is traditionally known in the art.

Figure 12:
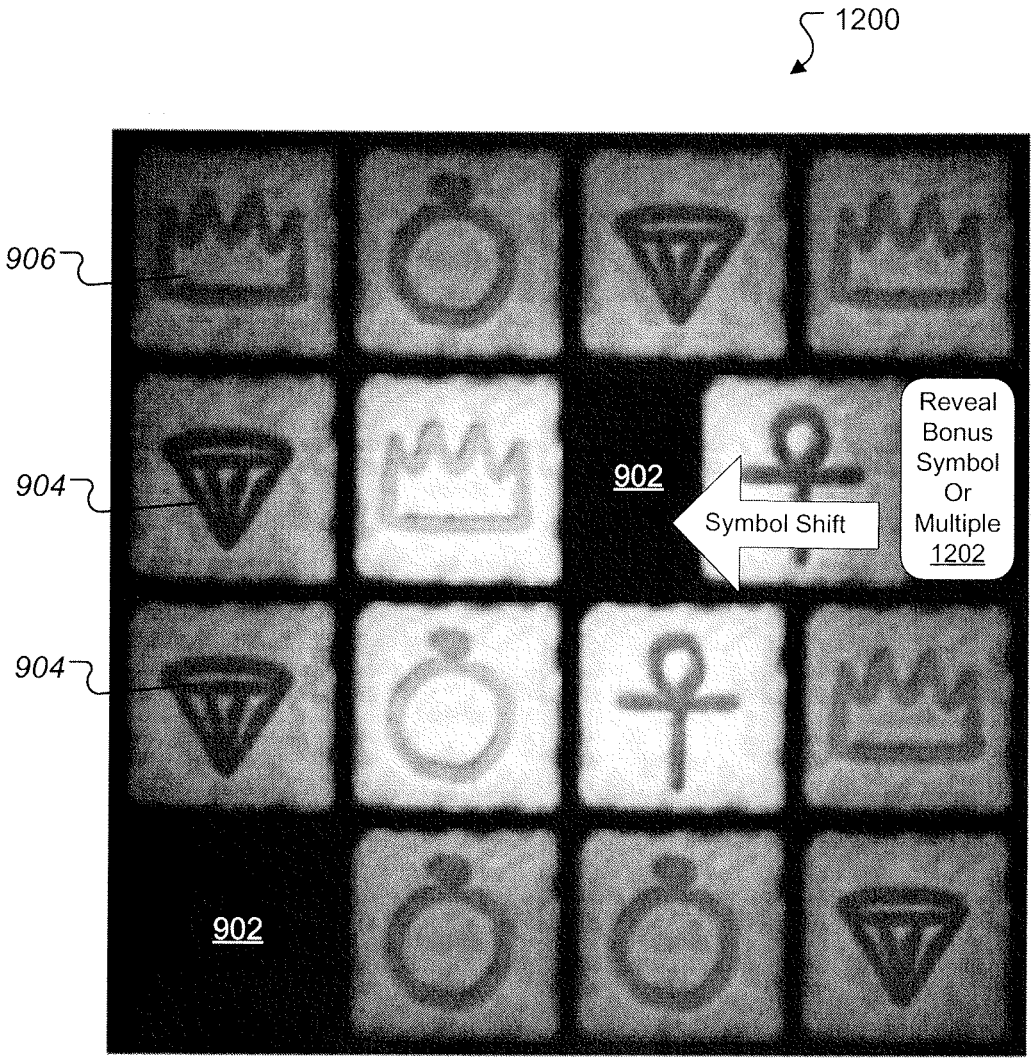
FIG. 12 shows an alternative symbol shifting process according to another embodiment.

FIG. 12 shows an alternative symbol shifting process according to another embodiment. The depicted symbol matrix 1 200 shows a symbol shifting process that would occur, in this alternative embodiment, also immediately after the symbol matrix shown in FIG. 9. However in this embodiment the shifting symbol does not necessarily leave behind a hole symbol when it moves. Some gaming symbols may shift to reveal hidden bonus symbols or prize multiplier ("multiple") symbol 1202, as is shown with regard to the depicted symbol shift indicated at the arrow labeled "symbol shift." The bonus symbols or multiplier symbol 1202 may have various effects on the game in different embodiments. In one embodiment, the bonus symbols are revealed, and then an animated sequence is shown to indicate that a bonus or a multiplier has been awarded, after which bonus symbol or multiplier symbol 1202 is removed from matrix 1200 in order to leave two hole symbols so that the game may continue shifting symbols without losing a hole symbol. In other embodiments, the total number of hole symbols will be reduced by one when a bonus symbol or multiplier symbol 1202 is revealed, but the game will continue shifting symbols until the allotted moves are completed or winning pattern is formed. In yet another embodiment, revealing a bonus symbol or a multiplier symbol may stop the game and award the bonus associated with the bonus symbol, or may affect the game in another manner such as adding one or more additional hole symbols to the matrix, or extending the number of moves permitted to try and solve the matrix in the current game round.

Any use of ordinal terms such as "first," "second," "third," etc., to refer to an element does not by itself connote any priority, precedence, or order of one element over another, or the temporal order in which acts of a method are performed. Rather, unless specifically stated otherwise, such ordinal terms are used merely as labels to distinguish one element having a certain name from another element having a same name (but for use of the ordinal term).

Further, as described herein, the various features have been provided in the context of various described embodiments, but may be used in other embodiments. The combinations of features described herein should not be interpreted to be limiting, and the features herein may be used in any working combination or sub-combination according to the invention. This description should therefore be interpreted as providing written support, under U.S. patent law and any relevant foreign patent laws, for any working combination or some sub-combination of the features herein.

The above described preferred embodiments are intended to illustrate the principles of the invention, but not to limit the scope of the invention. Various other embodiments and modifications to these preferred embodiments may be made by those skilled in the art without departing from the scope of the present invention.

The invention claimed is:

1. A method of providing a wagering game for a player at an electronic player station having an associated electronic processor, the method comprising:

(a) receiving, at a player input device associated with the player station, a wager input from the player, and determining an outcome for a wager associated with the wager input, the outcome being associated with a plurality of presolve scripts each configured to implement a game sequence for a different possible selection available to be made by the player;

(b) causing the processor to control an electronic display device associated with the player station to display a matrix of symbol locations including a plurality of symbol locations;

(c) causing the processor to control the electronic display device associated with the player station to further display a number of first symbols of a first symbol type at first selected symbol locations in the matrix, the first symbol type indicative of elements in the matrix that are made available to be used in forming patterns according to rules of the game;

(d) causing the processor to control the electronic display device associated with the player station to further display a number of second symbols of a second symbol type at second selected symbol locations in the matrix, the second symbol type indicative of hole elements in the matrix that may receive shifting symbols from other symbol locations in the matrix;

(e) receiving, at the player input device, a first player selection input indicating a chosen one of the first symbols in the matrix to be moved to the location of a selected adjacent one of the second symbols;

(f) in response to receiving the first player selection input, causing the processor to control the electronic display device to display a shift of the chosen one of the first symbols into the location of a selected adjacent one of the second symbols;

(g) based on the first player selection input, selecting one of the presolve scripts from the plurality of presolve scripts, and operating the electronic display device under control of the selected presolve script to display a number of secondary moves of the first symbols displayed at (c) into adjacent locations of second symbols after the move displayed in (f);

(h) after performing (g), causing the processor to determine the presence of one or more winning patterns in the matrix formed by the first symbols; and (j) in response to the processor finding a winning pattern, causing the processor to award a wager win result to the player.

2. The method of claim 1, wherein the second symbol type, which is indicative of hole elements in the matrix, is depicted as a blank location displaying in at least substantially all the location's area a background color or pattern of the matrix and distinguished from the first symbol type by the absence of a symbol graphic icon.

3. The method of claim 1, further comprising, revealing a multiplier element in the location from which the selected one of the first symbols is shifted.

4. The method of claim 1, wherein the second plurality of symbol locations is displayed in an initial display immediately following a symbol spinning or symbol changing sequence, responsive to the player wager input.

5. The method of claim 1, further comprising, before receiving the first player selection input, evaluating the matrix for presence of one or more winning patterns, in addition to the determination and award made in (h) and (j).

6. The method of claim 1, wherein shifting the selected one of the first symbols further comprises providing one of the second symbols at the original location of the chosen one of the first symbols.

7. A gaming system including:

a gaming device including (i) a display arrangement having one or more display devices, and (ii) a player input device arrangement having one or more player input devices;

a game controller arrangement for causing the display arrangement to (i) display a matrix of symbol locations including a plurality of symbol locations; to (ii) display a number of first symbols of a first symbol type at first selected locations in the matrix, the first symbol type indicative of elements in the matrix that are made available to be used in forming patterns according to rules of the game; to (iii) display a number of second symbols of a second symbol type at second selected locations in the matrix, the second symbol type indicative of hole elements in the matrix that may receive shifting symbols from other symbol locations in the matrix; for (iv) receiving a first player selection input indicating a chosen one of the first symbols in the matrix to be moved to the location of a selected adjacent one of the second symbols; for (v) causing, in response to receiving the first player selection input, the display arrangement to shift the chosen one of the first symbols into the location of a selected adjacent one of the second symbols; for (vi) based on the first player selection input, selecting one of a plurality of presolve scripts, and operating the display arrangement under control of the selected presolve script to display a number of secondary moves of the first symbols displayed at (ii) into adjacent locations of second symbols after the move displayed in (v); for (vii), after the number of secondary moves, determining the presence of one or more winning patterns in the matrix formed by the first symbols; and for (viii), in response to finding a winning pattern, awarding a wager win result to the player.

8. The system of claim 7, wherein the second symbol type, which is indicative of hole elements in the matrix, is depicted as a blank location displaying in at least substantially all the location's area a background color or pattern of the matrix and distinguished from the first symbol type by the absence of a symbol graphic icon.

9. The system of claim 7, wherein the gaming controller arrangement is further for revealing a multiplier element in the location from which the selected one of the first symbols is shifted.

10. The system of claim 7, wherein the second plurality of symbol locations is displayed in an initial display immediately following a symbol spinning or symbol changing sequence, which is performed immediately responsive to a player wager input.

* * * * *

UNITED STATES PATENT AND TRADEMARK OFFICE

CERTIFICATE OF CORRECTION

PATENT NO. : 8,435,110 B2
APPLICATION NO. : 12/463182
DATED : May 7, 2013
INVENTOR(S) : Galen Tanner Svanas It is certified that error appears in the above-identified patent and that said Letters Patent is hereby corrected as shown below:

In the Specification:

At Column 1, lines 11, 19, and 22; Column 2, lines 20, 47, and 49; Column 3, lines 40, 43, and 63; Column 4, lines 5, 22, and 45; Column 5, lines 4 and 35; Column 6, lines 23, 27, 33, and 47; Column 7, lines 16, 23, 55, and 57; Column 8, lines 27, 28, 36, 39, 46, and 53; Column 9, lines 2, 12, 15, 48, and 59; Column 10, lines 5, 45, 47, 54, and 55; Column 12, lines 6 and 9; Column 13, line 47; and Column 15, line 60, the word "gaining" should read --gaming--.

At Column 4, line 11; Column 6, line 53; and Column 8, line 12, "gain-" should read --gam- --.

At Column 11, line 57, "symbols arc" should read --symbols are--.

Signed and Sealed this
Seventeenth Day of September, 2013

Teresa Stanek Rea
*Deputy Director of the United StatesPatent and Trademark Office*